US007392586B2

(12) United States Patent
Tsukada et al.

(10) Patent No.: US 7,392,586 B2
(45) Date of Patent: Jul. 1, 2008

(54) SHEET FEED SHAFT

(75) Inventors: Sakae Tsukada, Ooizumigakuen-machi (JP); Eiji Tsukada, Ooizumigakuen-machi (JP)

(73) Assignee: Kabushiki Kaisha Tsukada Nezi Seisakusho (JP)

( * ) Notice: Subject to any disclaimer, the term of this patent is extended or adjusted under 35 U.S.C. 154(b) by 399 days.

(21) Appl. No.: 10/863,555

(22) Filed: Jun. 8, 2004

(65) Prior Publication Data

US 2004/0251617 A1 Dec. 16, 2004

(51) Int. Cl.
*B21D 53/00* (2006.01)

(52) U.S. Cl. ..... 29/895.3; 29/895.31

(58) Field of Classification Search ..... 29/895, 29/895.3, 895.31, 895.33, 34 R; 493/30, 493/36; 492/30, 33, 36
See application file for complete search history.

(56) References Cited

U.S. PATENT DOCUMENTS 5,971,638 A * 10/1999 Sato et al. ..... 400/578
6,532,661 B2 * 3/2003 Tsukada et al. ..... 29/895.31
2001/0021684 A1 * 9/2001 Tsukada et al. ..... 492/30
2004/0259706 A1 * 12/2004 Ueda et al. ..... 492/30

FOREIGN PATENT DOCUMENTS

JP 10-203675 8/1998

* cited by examiner

*Primary Examiner*—David H Bollinger
(74) *Attorney, Agent, or Firm*—McGlew & Tuttle, P.C.

(57) ABSTRACT

A sheet feed shaft is provided wherein mutually opposed spike-shape projections are formed throughout the whole surface of a metallic rod.

A rotational angle of a metallic rod (1) is controlled to form a plurality of spike-shape portions whose bristled directions are opposite to each other while supporting the metallic rod at both ends thereof and a pair of punch units (24) each having a pair of perforating edges (28) arranged orderly in an axial direction of the metallic rod (1) are reciprocated with respect to a circumferential surface of the metallic rod (1) simultaneously from both sides of the metallic rod to perforate the circumferential surface of the metallic rod, the metallic rod being allowed to rotate step by step in a successive manner during the perforating work.

6 Claims, 4 Drawing Sheets

SHEET FEED SHAFT

BACKGROUND OF THE INVENTION

1. Field of the Invention

The present invention relates to a sheet feed shaft to be used for feeding paper for example in a printing machine or in a printer for an office machine or for the feed of sheet such as a film in an overhead projector or the like, as well as an apparatus and method for manufacturing the sheet feed shaft.

2. Description of the Related Art

As to a sheet feed shaft to be used for the feed of paper in for example a printing machine or a printer for an office machine, as well as an apparatus and method for manufacturing the sheet feed shaft, the applicant in the present case has already proposed a sheet feed shaft and an apparatus and method for manufacturing the same in Japanese Patent Laid-Open No. Hei 10(1998)-203675 in which spike-shape projections are formed on the surface of a metallic rod.

More particularly, in the proposed sheet feed shaft manufacturing apparatus, as shown in FIG. 6, a V block 512 installed on a base 511 is used as a support base for supporting a metallic rod 51 as a workpiece, and the metallic rod 51 is lifted by a lifter 513 installed on the base 511. A collar 514 is wound round the metallic rod 51 to avoid direct contact of the metallic rod 51 with the lifter 513. A stock removing frame 515 is erected on the base 511 to prevent the metallic rod 51 after processing from being lifted in an engaged state with perforating edges 528 of a punch 524.

A split gear 517 is integrally mounted on a holding bush 516 which supports one end of the metallic rod 51, and is in mesh with a drive gear 519 of a stepping motor 518. The holding bush 516 is fixed to the metallic rod 51 with a screw 520. With power of an air cylinder (not shown) or the like, a tip end of a detent member 512 is engaged with the split gear 517.

A motor cylinder 522 is a multi-point positioning member whose tip end is put in abutment against one end of the metallic rod 51 through a magnet tip 523. A punch unit 524 is moved up and down by a press. A pair of perforating members 525 and 526 are fixed to the punch unit 524 with use of clamping means 527.

As shown in FIG. 7, stripe-shape arranged perforating edges 528 are formed in mutually opposed one surfaces of the pair of perforating members 525 and 526. The perforating members 525 and 526 are secured to the punch unit 524 by inserting the clamping means 527 into holes 529. As shown in FIG. 8, the pair of perforating members 525 and 526 are opposed to each other on the surface of the metallic rod 51 while maintaining a space settled previously corresponding to an outside diameter of the metallic rod 51. Likewise, the perforating edges 528 are opposed to each other on the surface of the metallic rod 51.

In the apparatus of such a structure, the punch unit 524 is moved up and down by a press, whereby the perforating edges 528 prick the surface of the metallic rod 51 in a successive manner to form spike-shape projections in an orderly arranged state and in directions contrary to each other.

In the conventional sheet feed shaft manufacturing apparatus, however, a support base for supporting the metallic rod 51 as a shaft body is needed. Besides, the V block 512 as the support base has a pair of support portions 512A for supporting the metallic rod 51, so that projections cannot be formed on the surface portions of the metallic rod 51 corresponding to the support portions 512A. Thus, portions free of projections remain on the metallic rod 51, that is, it is impossible to form projections throughout the whole surface of the shaft. Such an inconvenience can be avoided by processing the projections-free portions again through the same process as above to form projections. In this case, however, there arises an inconvenience such that the projections already formed are crushed by the support portions 512A. Thus, it is extremely difficult to form projections throughout the whole surface of the metallic rod 51.

Moreover, in the above conventional manufacturing apparatus, perforating edges 528 are provided on only the upper side and only the upper side of perforating edges 528 cut into the surface of the metallic rod 51 in a successive manner, going around the outer periphery of the metallic rod 51 to form a group of projections, thus giving rise to the problem that a long processing time is required.

Further, when the sheet feed shaft machined by the conventional manufacturing apparatus is applied to a printing machine and the size of sheet to be fed is changed, projections are not symmetric with respect to the newly-fed sheet, so that a non-uniform force is exerted on the sheet feed, giving rise to such an inconvenience as the sheet being fed in a distorted state.

More particularly, according to a certain change-over method for changing the sheet size from one to another, it is not determined unambiguously to which position of the shaft the sheet corresponds, so there occurs a case where projections are not symmetric right and left with respect to the sheet, thus resulting in that the sheet feeding force becomes non-uniform and the sheet being fed is distorted.

SUMMARY OF THE INVENTION

It is an object of the present invention to provide a sheet feed shaft having projections, the projections being formed closely and uniformly throughout the whole surface in both circumferential and axial directions of a metallic rod to prevent any size of paper from being distorted during feed thereof. It is another object of the present invention to provide a sheet feed shaft manufacturing apparatus and method not requiring a support base for supporting a metallic rod, capable of forming projections throughout the surface of the metallic rod, capable of shortening the processing time, and being less expensive.

For achieving the above-mentioned objects, in one aspect of the present invention there is provided a sheet feed shaft having a plurality of projections, the projections being formed by plastic working and bristling in a rotational direction on a circumferential surface of a metallic rod which is opposed to a feed roller through a sheet, characterized in that the projections comprise a plurality of spike-shape projections arranged in rows in both circumferential and axial directions and are formed in pairs by perforating peripheral surface portions of the metallic rod in one direction at two positions opposed to each other with respect to the axis of the metallic rod in such a manner that bristled directions of the projections are opposite to each other and by perforation in a direction opposite to the one direction.

In another aspect of the present invention there is provided a sheet feed shaft having a plurality of projections, the projections being formed by plastic working and bristling in a rotational direction on a circumferential surface of a metallic rod which is opposed to a feed roller through a sheet, characterized in that the projections comprise a plurality of spike-shape projections arranged in rows in both circumferential and axial directions and are formed in pairs by perforating peripheral surface portions of the metallic rod in one direction at two positions opposed to each other with respect to the axis of the metallic rod in such a manner that bristled directions of the projections are opposite to each other and by perforation in a direction opposite to the one direction, the pairs of the projections on the shaft being formed in a group by the perforations and other pairs of projections being formed in a group in adjacency thereto.

In a further aspect of the present invention there is provided a method for manufacturing a sheet feed shaft comprising: controlling a rotational angle of a metallic rod while supporting the metallic rod at both ends thereof, causing a pair of punch units each having a pair of perforating edges arranged orderly in an axial direction of the metallic rod to reciprocate with respect to a circumferential surface of the metallic rod simultaneously from both sides of the metallic rod, and carrying out perforation while causing the metallic rod to rotate step by step in a successive manner.

In a still further aspect of the present invention there is provided a method for manufacturing a sheet feed shaft comprising: controlling a rotational angle of a metallic rod while supporting the metallic rod at both ends thereof, causing a pair of punch units each having a pair of perforating edges arranged orderly in an axial direction of the metallic rod to reciprocate with respect to a circumferential surface of the metallic rod simultaneously from both sides of the metallic rod, making the perforating edges of one said punch unit and the perforating edges of the other punch unit coincident with each other circumferentially, and carrying out perforation throughout the whole circumference of the metallic rod while allowing the metallic rod to make a half turn in a successive manner.

DETAILED DESCRIPTION OF THE PREFERRED EMBODIMENTS

A first embodiment of the present invention will be described below in detail with reference to the drawings.

Figure 1:
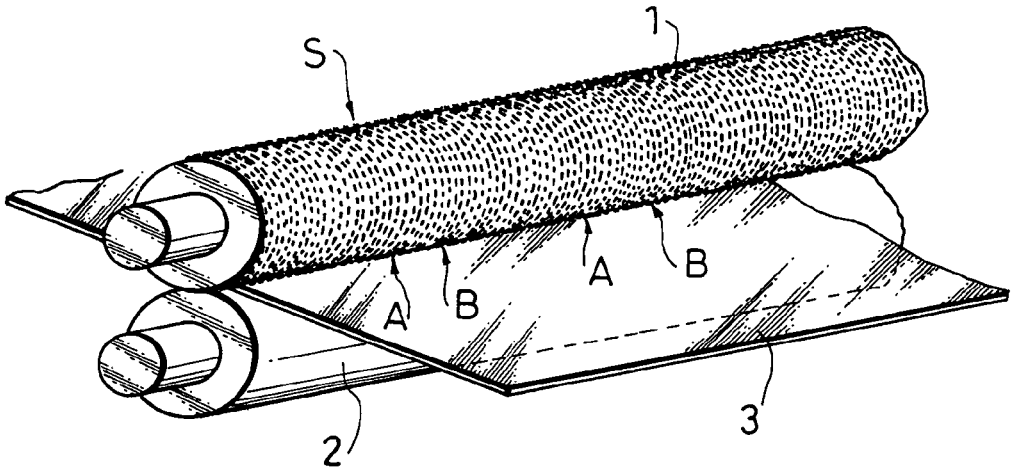
FIG. 1 is a conceptual diagram of usage of a sheet feed shaft according to a first embodiment of the present invention.

In FIG. 1, a sheet feed shaft S constituted by a metallic rod 1 is for feeding the sheet while holding the sheet between it and a feed roller 2 made of hard rubber for example when the shaft is applied to, for example, a printing machine or a printer for an office machine. Plural spike-shape projections A and B are formed closely in a state in which they stand up in a rotational direction on the surface of the metallic rod 1.

Figure 2:
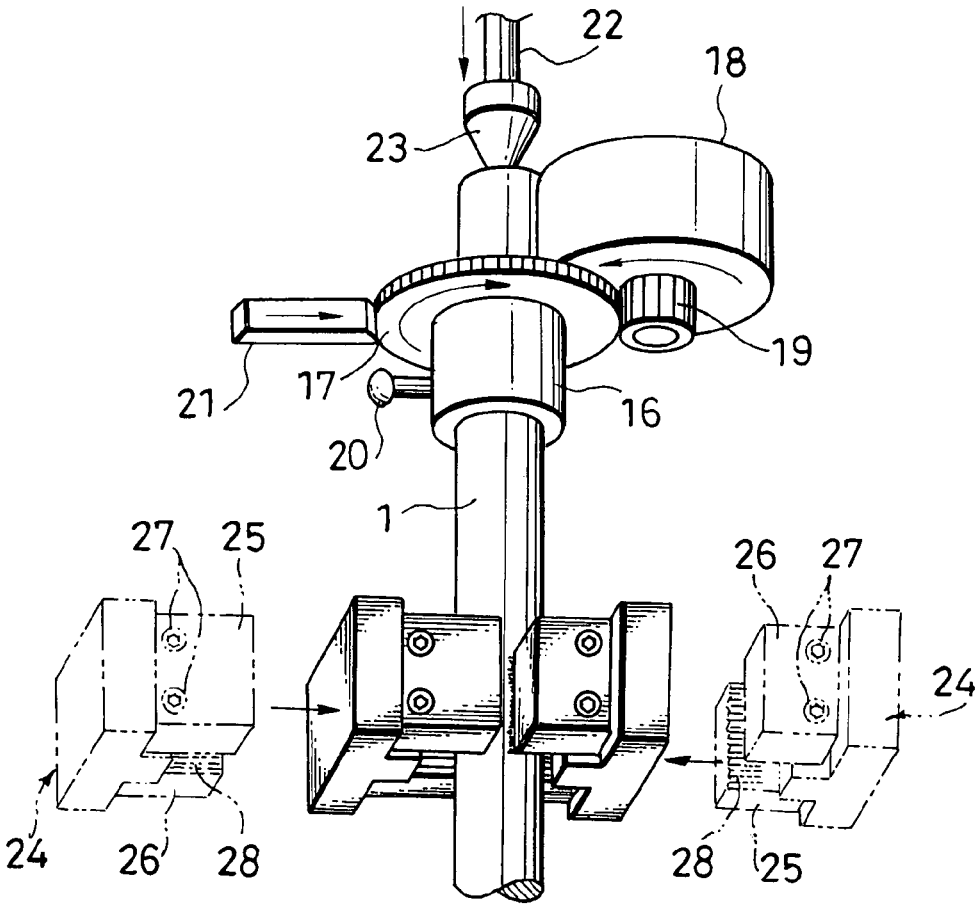
FIG. 2 is an explanatory diagram of a principal portion of an apparatus for manufacturing the sheet feed shaft in the first embodiment.

FIG. 2 illustrates an apparatus for manufacturing the sheet feed shaft S. The metallic rod 1 is held at both ends thereof by a pair of holding bushes 16. A split gear 17 is integrally mounted on the holding bush 16 which holds one end of the metallic rod 1 and is in mesh with a drive gear 19 of a stepping motor 18. One holding bush 16 is fixed to the metallic rod 1 with a screw 20. The holding bush 16 which holds the other end of the metallic rod 1 is omitted. With power of an air cylinder (not shown) or the like, a tip end of a detent member 21 is engaged with the split gear 17.

A motor cylinder 22 is a multi-point positioning means whose tip end is abutted against one end of the metallic rod 1 though a magnet tip 23. A pair of perforating members 25 and 26 are fixed to each of a pair of punch units 24 with clamping means 27. Each of the punch units 24 are pressed from both sides toward the surface of the metallic rod 1 by means of a press.

Figure 7:
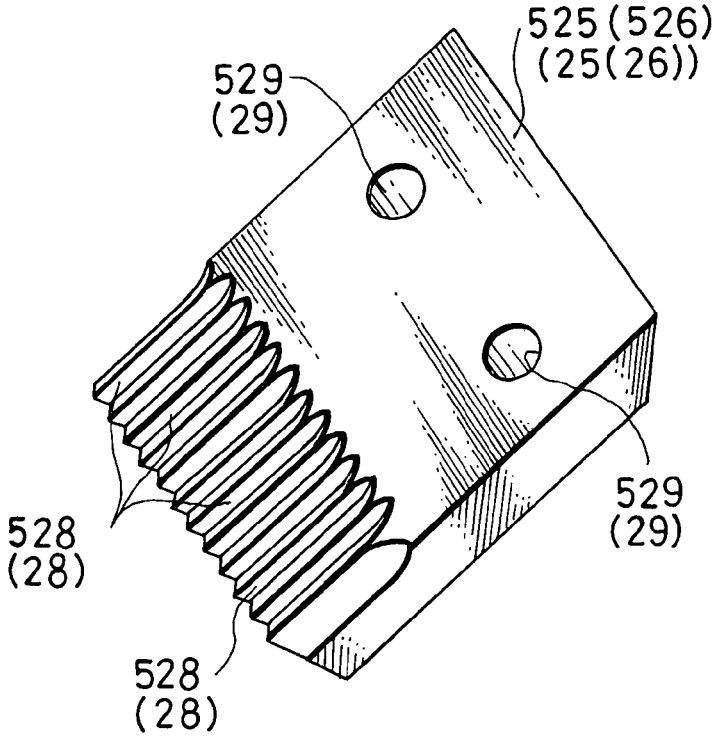
FIG. 7 shows perforating edges used in the present invention and in the conventional sheet feed shaft manufacturing apparatus.
Figure 8:
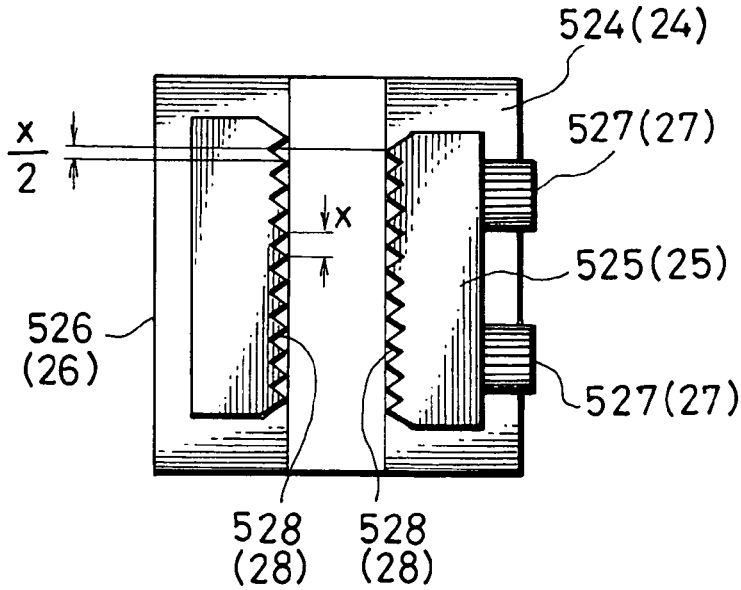
FIG. 8 shows perforating members and perforating edges used in the present invention and in the conventional sheet feed shaft manufacturing apparatus.

As is the case with the conventional counterpart shown in FIGS. 7 and 8, stripewise arranged perforating edges 28 are formed in one mutually opposed surfaces of each pair of perforating members 25 and 26, and the clamping means 27 are inserted into holes 29 to fix the perforating members 25 and 26. Like the conventional counterpart shown in FIG. 8, each pair of perforating members 25 and 26 are opposed to each other on the surface of the metallic rod 1 while maintaining a space settled previously corresponding to an outside diameter of the metallic rod 1, and the mutually opposed perforating edges 28 are opposed to each other with respect to the axis of the metallic rod 1 on the surface of the same rod.

As is apparent from FIG. 2, the punch units 24 are disposed on both sides of the metallic rod 1 opposedly to each other at 180°-displaced positions. According to such an arrangement, even if the conventional support base which bears the depressing force of each punch unit 24 is omitted, processing pressures of the punch units 24 offset each other, so that the perforating edges 28 of both punch units 24 can cut into the metallic rod 1 and perforate the rod simultaneously from both sides.

In the apparatus of such a construction, the pair of punch units 24 are pressed from both sides toward the surface of the metallic rod 1 by means of a press, whereby the perforating edges 28 cut into the surface of the metallic rod 1 in a successive manner and spike-shape projections A and B are formed in mutually opposite directions orderly in a successive manner under steps of a rotation of the metallic rod 1.

Figure 3:
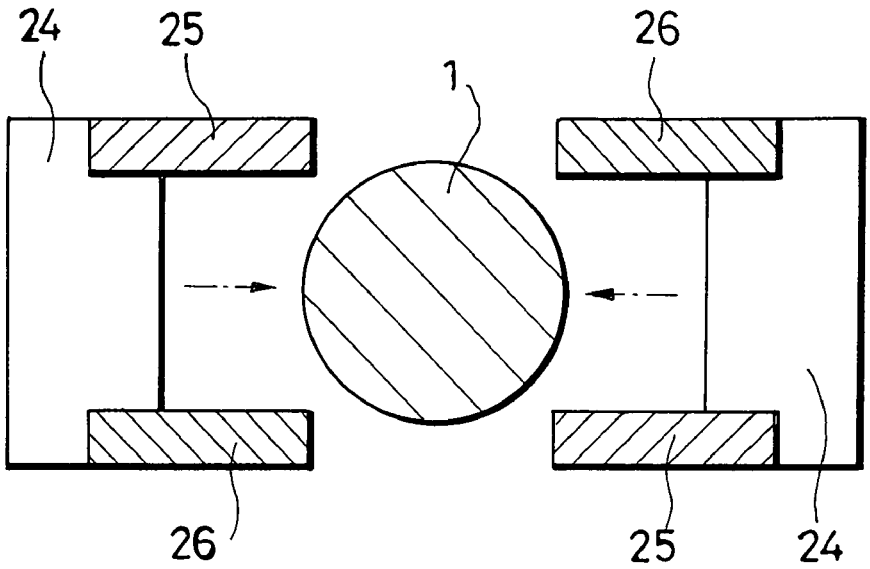
FIG. 3 is an explanatory diagram of a principal portion, showing a state before processing of the sheet feed shaft in the first embodiment.
Figure 4:
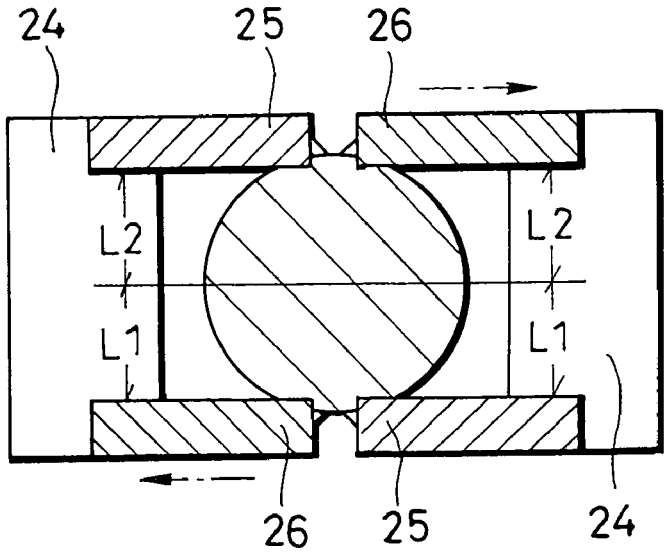
FIG. 4 is an explanatory diagram of a principal portion, showing a state during processing of the sheet feed shaft in the first embodiment.

FIG. 3 illustrates a state before formation of the projections A and B. As shown in FIG. 4, the punch units 24 are pressed from both sides toward the surface of the metallic rod 1, allowing the perforating edges to cut into rod surface, whereby projections A and B are formed in pairs and each in a row on both sides. In this case, if the pair of perforating edges 28 located on the same side with respect to the axis of the metallic rod 1 and opposed to each other are equidistant from the axis of the rod, it is possible to effect perforation from both sides while allowing the perforating edges 28 to cut into the metallic rod 1. This is because on the same side with respect to the axis of the metallic rod 1 the processing pressures of the punch units 24 offset each other and therefore a force tending to rotate the metallic rod 1 is not exerted on the rod.

In the perforating members 25 and 26 shown in FIGS. 3 and 4, distances L1 and L2 on the right and left sides of the axis need not be equal to each other. If the upper and lower perforating edges 28 which confront each other on the same side are equidistant from the axis, a force tending to rotate the metallic rod 1 is not exerted on the rod, so that it is possible to effect perforation from both sides. In the case where the distances L1 and L2 are different from each other, it is possible to form projections A and B different in height.

Regarding how to operate the split gear 17, the drive gear 19 of the stepping motor 18, the detent member 21, the motor cylinder 22 and the magnet tip 23, it is the same as in the prior art and therefore a detailed description thereof will here be omitted.

In this way the pair of punch units 24 are pressed repeatedly from both sides toward the surface of the metallic rod 1 and the rod surface is pricked by the perforating edges, whereby a group of projections A and B are formed in pairs on the surface of the metallic rod 1 correspondingly to the width of the stripewise arranged perforating edges 28.

Next, the punch units 24 move along the axis of the metallic rod 1 up to a position where the projections A and B are not formed. Then, in the same manner as above, the punch units 24 are pressed repeatedly from both sides toward the surface of the metallic rod 1 and the rod surface is pricked by the perforating edges, whereby a group of projections A and B are formed in pairs on the surface of the metallic rod 1 correspondingly to the width of the stripewise arranged perforating edges 28 and contiguously to the already perforated portion.

In the conventional apparatus, since the metallic rod 1 is subjected to processing in only one direction by the punch unit 24, it is necessary to use the V block 512 as a support base for supporting the metallic rod 1, and if projections are formed on the metallic rod 1 at positions corresponding to support portions 512A of the support base, the projections are crushed and therefore it is impossible to form projections at such positions. On the other hand, in the above method according to the present invention, such a support base is not needed and therefore a group of projections A and B can be formed in pairs contiguously to the already processed portion. Since such a processing is carried out continuously, projections A and B are formed closely in pairs throughout the whole surface in both circumferential and axial directions of the metallic rod 1, as shown in FIG. 1.

As in the conventional case, by perforating the peripheral surface of the metallic rod 1 at two positions opposed to each other with respect to the axis of the rod, such plural projections A and B are formed in pairs in the shape of spikes so as to have mutually opposite bristled directions and in rows in both circumferential and axial directions. The projections are formed by simultaneously performing the perforating work in one direction to form the projections in pairs and the perforating work in a direction opposite to the one direction.

More specifically, the rotational angle of the metallic rod 1 is controlled while supporting the rod at both ends thereof, the pair of punch units 24 each having the perforating members 25 and 26 formed with a pair of perforating edges 28 which are arranged regularly in the axial direction of the metallic rod 1 are driven to reciprocate with respect to a circumferential surface simultaneously from both sides of the metallic rod 1, and perforation is allowed to proceed while rotating the metallic rod 1 step by step in a successive manner, whereby after one full turn there are formed the projections A and B throughout the circumference on the surface of the sheet feed shaft.

When perforation in the one direction to form the projections in pairs and perforation in a direction opposite to the one direction are carried out simultaneously, by making the perforating edges 28 of the one punch unit 24 and the perforating edges 28 of the other punch unit 24 coincident with each other circumferentially, the perforating work can be done throughout the whole circumference at the end of a half turn resulting from successive rotation step by step of the metallic rod 1.

Figure 6:
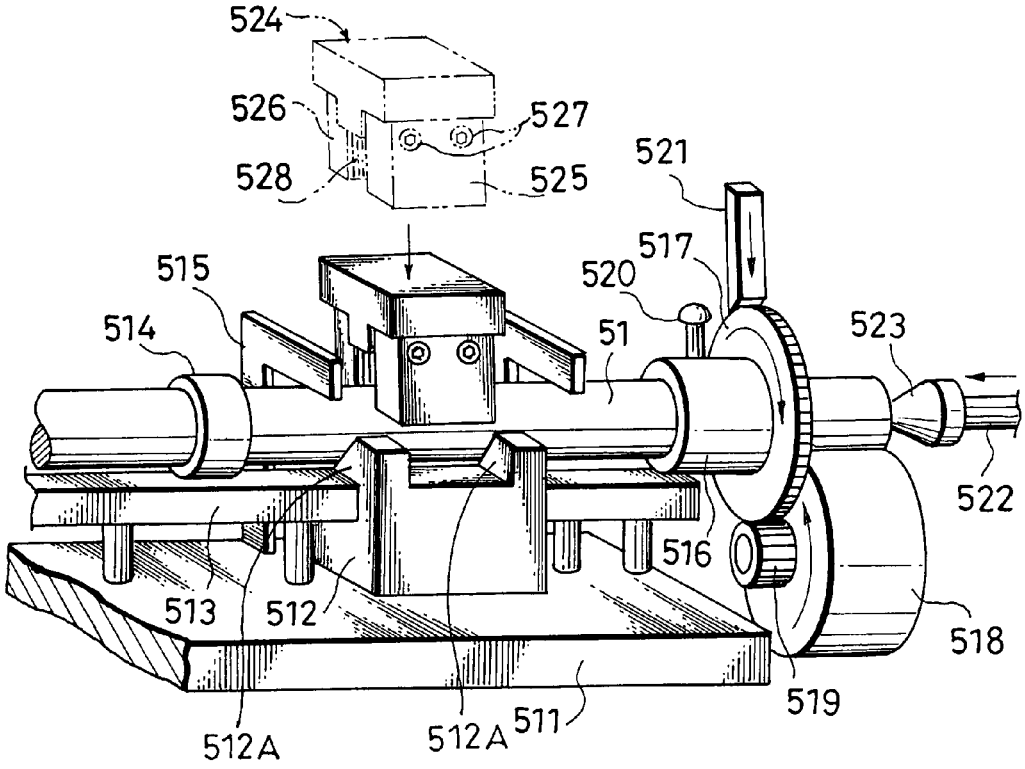
FIG. 6 is an explanatory diagram of a principal portion of a conventional sheet feed shaft manufacturing apparatus.

As shown in FIG. 2, it is preferable that the pair of punch units 24 be disposed in the transverse direction of the metallic rod 1. If the punch units 24 are disposed vertically as in FIG. 6 which illustrates the conventional arrangement, dust resulting from the perforating work accumulates between the perforating edges 28 located on the lower side and is eventually stuck between the edges, thus giving rise to an inconvenience. FIGS. 2, 3 and 4 show that directions indicated by arrows correspond to the transverse direction. In this case, therefore, dust resulting from the perforating work falls toward the lower perforating members 25 and 26. Since tip ends of the perforating edges 28 are in registration, there is no fear of dust being stuck therebetween.

Figure 5:
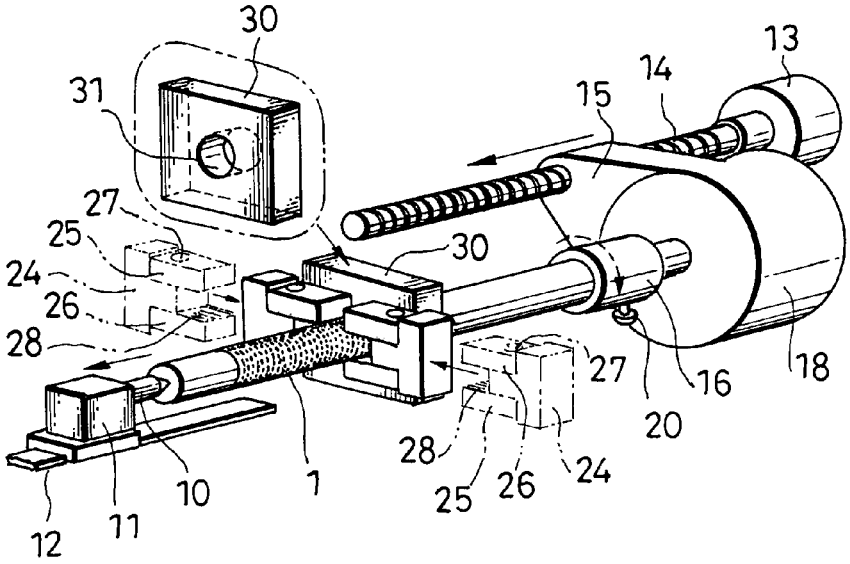
FIG. 5 is an explanatory diagram of a principal portion of an apparatus for manufacturing a sheet feed shaft according to a second embodiment of the present invention.

Next, a description will be given of a sheet feed shaft manufacturing apparatus and a method for operating the same according to a second embodiment of the present invention illustrated in FIG. 5. Portions which exhibit the same functions as in FIG. 2 are identified by the same reference numerals as in FIG. 2. One end of a metallic rod 1 is held by being fixed to a holding bush 16 with a screw 20, while the other end thereof is fixed by being abutted against a spindle 10. The spindle 10 is fixed to a spindle base 11 and is supported slidably in the axial direction of the metallic rod 1 along a guide plate 12 which is fixed to a press body.

A stepping motor 18, which is constructed integrally with the holding bush 16, controls an indexing angle of the metallic rod 1 by rotation. Like the guide plate 12, the stepping motor 18 is supported slidably in the axial direction of the metallic rod 1 by a known method.

A pulse motor 13 controls a lead screw 14 by rotation and thereby causes the lead screw 14 to be fitted in a portion 15 of the stepping motor 18 to control forward or backward movement of the stepping motor 18 in the axial direction of the metallic rod 1. The pulse motor 13 and the lead screw 14 constitute a single screw actuator.

A support block 30 is fixed to the press body and has a hole 31 extending in the axial direction of the metallic rod 1. A to-be-perforated stock of the metallic rod 1 is inserted through the hole 31 to prevent deformation of the metallic rod 1 during a perforating work. In FIG. 5, the support block 30 is hidden by punch units 24 and therefore a detailed shape thereof is shown on a left upper side. To form a plurality of spike-shape portins whose bristled directions are opposite to each other A description will now be given of the operation of the sheet feed shaft manufacturing apparatus constructed as above. The rotational angle of the metallic rod 1 is controlled to form a plurality of spike-shape portions whose bristled directions are opposite to each other while supporting the metallic rod at both ends thereof, and then the pair of punch units 24 having perforating members each formed with a pair of perforating edges 28 arranged orderly in the axial direction of the metallic rod 1 are reciprocated with respect to a circumferential surface simultaneously from both sides of the metallic rod 1, whereby the metallic rod 1 is perforated while being rotated step by step in a successive manner, and at the end of one full turn of the rod there can be formed the projections A and B throughout the whole circumferential surface of the metallic rod 1 as a sheet feed shaft.

Next, with the single screw actuator, the metallic rod 1 is moved along the axis thereof up to a position where the projections A and B are not formed, then in the same way as in the processing described above the punch units 24 are pressed repeatedly from both sides toward the surface of the metallic rod 1 and the perforating edges cut into the rod surface, whereby a group of projections A and B are formed in pairs over the surface area corresponding to the width of the stripe-shape arranged perforating edges 28 and contiguously to the portion already processed.

In this connection, the hole 31 is fitted on the outer peripheral surface of the metallic rod 1 through a slight gap, so when the metallic rod is rotated by the stepping motor 18 and when it is moved by the single screw actuator, the support block 30 ensures a smooth operation and prevents deformation of the metallic rod 1 during the perforating work.

The present invention is not limited to the above embodiments, but changes may be made within the scope of the technical idea of the present invention.

According to the present invention there are obtained the following effects.

In a first aspect of the present invention there is provided a sheet feed shaft having a plurality of projections, the projections being formed by plastic working and bristling in a rotational direction on a circumferential surface of a metallic rod which is opposed to a feed roller through a sheet, characterized in that the projections comprise a plurality of spike-shape projections arranged in rows in both circumferential and axial directions and are formed in pairs by perforating peripheral surface portions of the metallic rod in one direction at two positions opposed to each other with respect to the axis of the metallic rod in such a manner that bristled directions of the projections are opposite to each other and by perforation in a direction opposite to the said one direction.

According to this construction, since the projections on the shaft are formed by perforation in one direction to form projections in pairs and by perforation in a direction opposite to the one direction, it is possible to form the projections even without the shaft support base and further possible to reduce the projections forming time by half.

In a second aspect of the present invention there is provided a sheet feed shaft having a plurality of projections, the projections being formed by plastic working and bristling in a rotational direction on a circumferential surface of a metallic rod which is opposed to a feed roller through a sheet, characterized in that the projections comprise a plurality of spike-shape projections arranged in rows in both circumferential and axial directions and are formed in pairs by perforating peripheral surface portions of the metallic rod in one direction at two positions opposed to each other with respect to the axis of the metallic rod in such a manner that bristled directions of the projections are opposite to each other and by perforation in a direction opposite to the one direction, the pairs of the projections on the shaft being formed in a group by the perforations and another pairs of projections being formed in a group in adjacency thereto.

According to this construction, since a group of projections of the shaft are formed in pairs by a single perforating process and another group of projections are formed in pairs in adjacency thereto, it is possible to form projections throughout the whole surface of the shaft. Therefore, with such a shaft, the feed of sheet is carried out uniformly without distortion because the projections are present throughout the whole surface of sheet when the sheet size is changed from one to another.

In a third aspect of the present invention there is provided a method for manufacturing a sheet feed shaft comprising: controlling a rotational angle of a metallic rod to form a plurality of spike-shape portions whose bristled directions are opposite to each other while supporting the rod at both ends thereof, causing a pair of punch units each having a pair of perforating edges arranged orderly in an axial direction of the metallic rod to reciprocate with respect to a circumferential surface of the metallic rod simultaneously from both sides of the metallic rod, and carrying out perforation while causing the metallic rod to rotate step by step in a successive manner.

According to this construction, since the pair of punch units are reciprocated with respect to the circumferential surface of the metallic rod simultaneously from both sides of the metallic rod, there is proposed a sheet feed shaft manufacturing method which not only makes the use of a shaft support base unnecessary during the perforating work but also can halve the time taken to form projections by the simultaneous perforation from both sides.

In a fourth aspect of the present invention there is provided a method for manufacturing a sheet feed shaft comprising: controlling a rotational angle of a metallic rod to form a plurality of spike-shape portions whose bristled directions are opposite to each other while supporting the rod at both ends thereof, causing a pair of punch units each having a pair of perforating edges arranged orderly in an axial direction of the metallic rod to reciprocate with respect to a circumferential surface of the rod simultaneously from both sides of the metallic rod, making the perforating edges of one said punch unit and the perforating edges of the other punch unit coincident with each other circumferentially, and carrying out perforation throughout the whole circumference of the metallic rod while allowing the metallic rod to make a half turn in a successive manner.

According to this construction, the perforating edges of one punch unit and the perforating edges of the other punch unit are made coincident with each other circumferentially and the metallic rod is allowed to make a half turn while rotating step by step in a successive manner to perforate the metallic rod throughout the whole circumferential area, whereby the time required to form the projections can be reduced by half.

Consequently, according to the present invention it is possible to provide a sheet feed shaft, as well as an apparatus and method for manufacturing the same, capable of making the use of a support base unnecessary which support base is for supporting the shaft during formation of the projections, capable of forming the projections throughout the whole surface of the shaft, further capable of shortening the working time, being inexpensive, and not causing distortion in any size of paper being fed.

What is claimed is:

1. A method for manufacturing a sheet feed shaft comprising:

providing a metallic rod with a circumferential surface having a defined length;

supporting said metallic rod at each end;

providing a pair of punch units, each punch unit having a pair of perforating members, one punch unit being located on one side of said metallic rod, another punch unit being located on another side of said metallic rod such that said another punch unit is disposed 180° opposite said one punch unit, each perforating member having perforated edges arranged in an axial direction with respect to said metallic rod;

controlling a rotational angle of said metallic rod;

simultaneously reciprocating each punch unit such that said one punch unit approaches said metallic rod from a first direction and said another punch unit approaches said metallic rod from a direction opposite said first direction, whereby said perforated edges are forced into said circumferential surface from both sides of said metallic rod to form a plurality ofspike-shape portions whose bristled directions are opposite to each other, said metallic rod being rotated step by step in a successive manner, said plurality of spike-shape portions extending along entire length of said circumferential surface of said metallic rod.

2. A method for manufacturing a sheet feed shaft comprising:

providing a metallic rod with a circumferential surface having a defined length;

supporting said metallic rod at each end;

providing a pair of movable punch units, each punch unit having a set of perforating elements, one punch unit being located one side of said metallic rod, another punch unit being located on another side of said metallic rod such that said one punch unit is opposite said another punch unit, each perforating element having perforated edges arranged in an axial direction with respect to said metallic rod;

controlling a rotational angle of a metallic rod to form a plurality of spike-shape portions whose bristled directions are opposite to each other while supporting the metallic rod at both ends thereof;

reciprocating said pair of punch units simultaneously from both sides of the metallic rod such that said one punch unit engages said metallic rod from a first direction and said another punch unit engages said metallic rod in a direction opposite said first direction, whereby the perforating edges of one punch unit is circumferentially coincident with the perforating edges of the other punch unit, said perforating edges perforating the whole circumference of said metallic rod, whereby said metallic rod rotates a half turn in a successive manner, said plurality of spike-shape portions extending along entire length of said circumferential surface of said metallic rod.

3. A method for manufacturing a sheet feed shaft comprising:

providing a metallic rod with a circumferential surface having a defined length;

supporting said metallic rod at each end thereof and without a support contacting a location intermediate of said each end;

providing a first punch unit having a first pair of perforating members, said first punch unit being movable along length of said metallic rod, said first punch unit being located on one side of said metallic rod, each first perforating member having first perforated edges arranged in an axial direction with respect to said metallic rod;

providing a second punch unit having a second pair perforating members, said second punch unit being movable along length of said metallic rod, said second punch unit being located on another side of said metallic rod such that said second punch unit is opposite said first punch unit, each second perforating member having second perforated edges arranged in an axial direction with respect to said metallic rod;

controlling a rotational angle of said metallic rod;

simultaneously reciprocating said first punch unit and said second punch unit such that said first perforated edges and said second perforated edges are forced into said circumferential surface of said metallic rod, whereby a first plurality of spike-shape portions and a second plurality of spike-portions are formed on said circumferential surface of said metallic rod, said first plurality of spike-shape portions extending in one circumferential direction, said second plurality of spike-shape portions extending in another circumferential direction, said one circumferential direction being opposite said another circumferential direction, said metallic rod being rotated step by step in a successive manner, said plurality of spike-shape portions extending along entire length of said circumferential surface of said metallic rod, said first plurality of spike-shape portions being adjacent said second plurality of spike-shape portions.

4. A method in accordance with claim 3, wherein said first punch unit and said second punch unit are disposed in a direction transverse of said metallic rod such that said first punch unit moves in a direction opposite said second punch unit.

5. A method in accordance with claim 3, wherein said first punch unit is circumferentially coincident with said second punch unit when said first punch unit and said second punch unit are reciprocated.

6. A method in accordance with claim 3, wherein said first plurality of spike-shape portions is adjacent said second plurality of spike-shape portions.

* * * * *